United States Patent [19]

Day

[11] 4,355,796

[45] Oct. 26, 1982

[54] APPARATUS FOR SEPARATING SHEETS FROM A STACK

[75] Inventor: George W. Day, Dovercourt, England

[73] Assignee: Vacuumatic Limited, Harwich, England

[21] Appl. No.: 161,544

[22] Filed: Jun. 20, 1980

[30] Foreign Application Priority Data

Jun. 21, 1979 [GB] United Kingdom ..... 7921612

[51] Int. Cl.[3] ..... B65H 3/30

[52] U.S. Cl. ..... 271/20; 271/23; 271/99; 271/104; 271/106; 271/112; 271/166

[58] Field of Search ..... 271/91, 94, 99, 101, 271/104, 106, 112, 165, 166, 23, 20

[56] References Cited

U.S. PATENT DOCUMENTS 3,599,970 8/1971 Smithe ..... 271/101 X

FOREIGN PATENT DOCUMENTS 305738 5/1975 U.S.S.R. ..... 271/101

*Primary Examiner*—Richard A. Schacher

*Attorney, Agent, or Firm*—Beveridge, DeGrandi & Kline

[57] ABSTRACT

There is disclosed an apparatus for separating sheets at the bottom of a stack comprising two contrarotating suction drum assemblies (14,15:17) and a suction pipe (18) extending between the two assemblies. In order to ensure that the edges of the lowermost sheet are fully separated from the sheet above before the sheet is extracted from the bottom of the stack, one assembly has a central suction drum (14) having suction outlets (25) and the other assembly (17) has suction outlets (29) to draw the edges of the lowermost sheet in their central regions downwardly from the sheet above. Two pairs of contrarotating double ended fingers (32) are mounted on either side of the drum assemblies to enter the stack above the lowermost sheet where the central region has been drawn downwardly and to move along the edges of the stack towards the ends of the stack to separate the edges of the lowermost sheet from the sheet above. The drum assembly (15) has two outer suction drums (15) which rotate at twice the speed of the central drum section (14) and have suction ports (33) activated when the fingers (32) have separated the edges of the lowermost sheet to draw the lowermost sheet out of the bottom of the stack.

17 Claims, 4 Drawing Figures

APPARATUS FOR SEPARATING SHEETS FROM A STACK

FIELD OF THE INVENTION

This invention relates to apparatus for separating sheets from a stack and is particularly although not exclusively applicable to apparatus for separating and counting used bank notes.

BACKGROUND OF THE INVENTION

Stacked sheets of paper, notes and the like are commonly difficult to separate and count because the corners of adjacent sheets may be folded together and interlocked thus preventing the notes from separating cleanly.

U.K. Patent Specification No. 1,363,859 discloses an apparatus for separating signatures at a corner of a stack of signatures by means of a sucker mounted on a pivoted arm arranged to draw a corner of a lowermost signature downwardly. A continuously rotating disc has a periphery which engages in the corner of the stack, a part of the disc being cut away to allow the pivoted sucker arm to operate. Once the arm has drawn a corner of the signature downwardly, the periphery of the disc engages in the corner to support the corner of the stack whilst the lowermost sheet is extracted from the stack. If however other parts of the signatures are folded together or otherwise interlocked, it may not be possible to extract the lowermost sheet from the stack without disturbing a sheet or sheets above with which the lowermost sheet is interlocked.

An object of this invention is to release any interlocked parts of superimposed sheets in a stack before separating sheets from the bottom of the stack.

SUMMARY OF THE INVENTION

The invention provides an apparatus for separating sheets from a stack comprising, means to support a stack of sheets leaving edge portions on either side of the stack un-supported, suction means to draw central regions of said edge portions of the lowermost sheet downwardly, separator means for penetrating either side of the stack between the downwardly drawn central regions of the lowermost sheet and the stack above and for passing along the length of the edge portions to the ends of the stack to separate fully the edge portions from the stack above, and means to draw out the lowermost sheets from the bottom of the stack.

DESCRIPTION OF THE PREFERRED EMBODIMENTS

Figure 1:
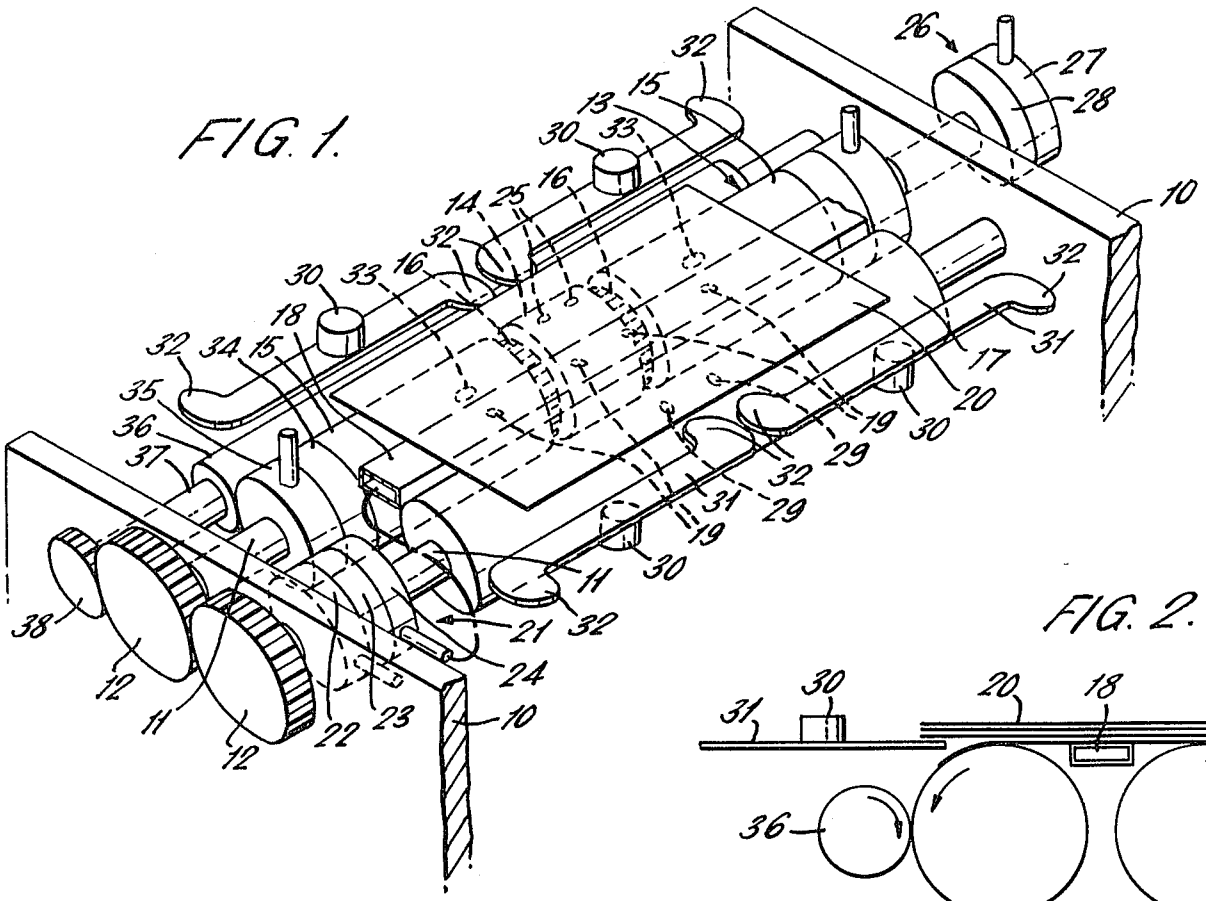
FIG. 1 is a plan view of an apparatus for separating and counting banknotes.

The drawings show an apparatus for separating and counting bank notes comprising a frame including spaced parallel members 10 in which a pair of parallel shafts 11 are mounted for rotation. At one end of the frame the drive shafts 11 extend through the frame and two identical diameter inter-meshing gears 12 are fixed to the shafts so that the shafts always rotate together at the same speed in opposite directions. A drive motor (not shown) has a driving gear meshing with one of the gears 12 for rotating the shafts.

One of the shafts 11 carries a cylindrical roller assembly indicated generally at 13 comprising a central roller 14 mounted mid-way along the shaft 11 and two further rollers 15 disposed on either side of the roller 14. The roller 14 is fixed to the shaft 11 to rotate with the shaft whereas the rollers 15 are freely rotatable on the shaft. The rollers 15 have end gears 16 adjacent the central roller 14 and the gears mesh with further gears (not shown) driven by the aforesaid drive motor so that the rollers 15 rotate in the same direction as the roller 14 but at twice the speed of the roller 14. The other shaft 11 carries a single roller 17 extending substantially the length of the roller assembly 13 and fixed to the shaft to rotate therewith. The roller 17 thus rotates at the same speed as the roller 14 but in the opposite direction and the direction of rotation of the shafts 11 is such that the upper parts of the rollers move outwardly away from each other as indicated by the arrows.

A hollow bar 18 is mounted between the upper parts of the roller assembly 13 and the roller 17 and has upwardly open suction inlets 19 spaced apart along the bar. The bar 18, roller assembly 13 and roller 17 between them support a stack of banknotes or other sheets to be counted as indicated at 20 in FIG. 2.

The hollow bar 18 is connected to a source of vacuum (not shown) through a rotary valve 21 mounted on the shaft 11 of the roller 17. The rotary valve 21 comprises a stationary element 22 connected directly to the source of vacuum, a rotary element 23 fixed to the shaft 11 and a further stationary element 24 having an outlet connected to the interior of the bar 18. The porting between the stationary and rotary elements 22 to 24 is arranged so that vacuum is supplied to the suction inlet 19 to hold the lowermost note of a stack of notes in place except when the note is to be drawn out of the stack as described later, the vacuum to the suction inlets 19 being switched off by the valve 21 at this time.

Figure 2:
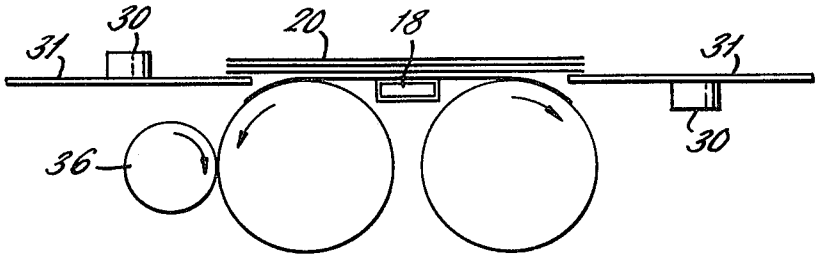
FIG. 2 is an end view of the apparatus shown in FIG. 1.

The short central roller 14 on the shaft 11 has a pair of suction inlets 25 disposed apart along the shaft 11 and intended to act on the lowermost note of the stack to either side of the centre of the note (where a used note is likely to be worn and in poor condition). The suction inlets 25 are connected through passages in the shaft 11 to a rotary valve 26 comprising a stationary element 27 connected to the source of vacuum referred to above and a rotary element 28 fixed to the shaft 11. Porting between the stationary element 27 and the rotary element 28 is such that vacuum is supplied to the suction inlets 25 between the top dead centre position of the inlets and a position where the inlets are to one side of the top dead centre. The effect of the suction at the inlets 25 is to draw the central region of the edge portion of the banknote downwardly on to the surface of the roller 14 as shown in FIG. 2 and the valve 26 is arranged to switch the suction to the inlets 25 off when the inlets 25 reach the edge of the note.

The roller 17 has two similar suction inlets 29 spaced in the direction of the shaft 11 immediately to either side of the centre of the roller and the suction inlets 29 are connected through a passage in the shaft 11 to a rotary valve (not shown) identical to the valve 26. The valve 26 is arranged to apply suction to the inlets 29 in a similar manner to the application of suction to the inlets 25 by the valve 26 so that the central part of the other edge of the lowermost note is drawn downwardly by the suction inlets 29 as shown in FIG. 2.

Two pairs of upright rotary spindles 30 are mounted on either side of the roller assembly, the spindles being connected through drive connections to the drive motor to rotate therewith. Each spindle carries a pair of fingers 31 projecting on opposite sides of the spindle each finger having an end nose 32. The two adjacent spindles on each side of the roller assembly are driven in contra-rotating directions at one half the speed of rotation of the rollers 14 and 17. As the spindles rotate, one pair of the noses and each pair of spindles moves into the stack of notes at the location where the central edge portion of the lowermost note has been separated from the stack above and as the fingers continue to rotate, the noses 32 move through the stack outwardly to the ends of the stack thus ensuring that the edge portions of the lowermost note are freed from the notes of the stack above along the full length of the edge portions. If, as may happen in the case of used notes, the corners of the edge portion of the lowermost note are folded over the corners of notes above, the fingers release the folded corners. The fingers 31 adjacent the roller 17 on the other side of the stack act in the same way so that both edge portions of the lowermost note are released from the remainder of the stack for the full length of the edge portions. As indicated earlier, the spindles 30 rotate at half the speed of the rollers 14 and 17 so that alternate fingers 31 on the spindles are presented to the stack.

As the fingers 31 reach the ends of the stack, separation of the lowermost note is completed and the note is then ready to be withdrawn from the stack whilst the stack above is still temporarily supported by the fingers. For this purpose, the rollers 15 are provided with suction inlets 33 which are connected through passages in the rollers to rotary valve 34 at the outer ends of the roller parts 15 on the shaft 11. Each rotary valve 34 includes a stationary element 35 having porting connected to the rotary element and having a connection to the aforesaid source of vacuum. The ports 33 are arranged to reach the top dead centre positions as soon as the fingers 31 have passed through the stack and the valves 34 are arranged to communicate the vacuum to the ports 33 when at the top dead centre position and at the same time the valve 23 is arranged to switch off the vacuum to the suction ports 19 in the bar 18. As the rollers 15 continue to rotate, the lowermost leaf is drawn outwardly and downwardly from the bottom of the stack whilst the stack is temporarily supported on the fingers 31 still engaged in the stack. A further roller 36 of a smaller diameter than the roller 15 is mounted adjacent the surface of the roller 15 to form a nip therewith on a shaft 37 mounted in the frame 10. The shaft 37 carries a gear wheel 38 meshing with one of the wheels 12 referred to earlier so that the roller 36 is driven in contra-rotation with the rollers 15. The leading edge of the note withdrawn from the stack is drawn into the nip with the roller 36 delivering the note downwardly past a photo-cell or other device for counting the notes delivered and thence on to a collection device.

As indicated earlier, the rollers 15 are geared up in relation to the roller 14 by a factor of 2:1 so that the note is fully withdrawn from the stack by the time the suction inlets 25 on the roller 14 reach the top dead centre position again to act on the next note in the stack. The gearing up ratio may of course be more than 2:1 where it is thought desirable to remove the note more rapidly from the stack. Equally more fingers can be provided on the spindles 30 to complete the separation of the edge portions of the notes more rapidly if required.

The embodiment described above relates to the separation and counting of banknotes. The apparatus is equally applicable to separating and counting other sheets of papers in a stack where an accurate account of the number of sheets is required.

Figures 3, 4:
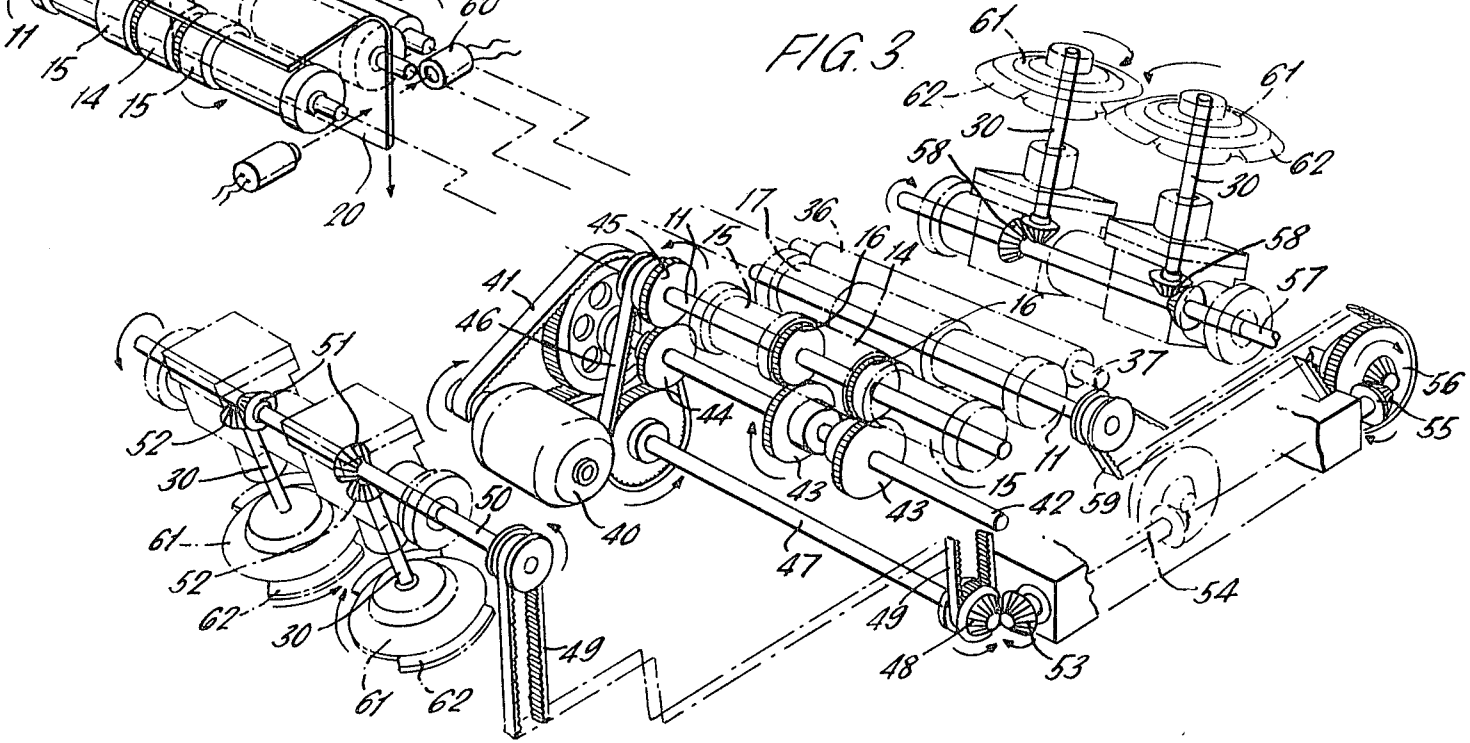
FIGS. 3 and 4 show a further form of the apparatus.

Reference is now made to the further embodiment of the invention illustrated in FIGS. 3 and 4 of the drawings which is generally similar to the first described embodiment and like parts have been allotted the same reference numerals. The system of rollers and rotary valves is substantially the same as that of the previously described embodiment but the drive system for the various elements is illustrated in greater detail and will now be described. At one end of the system of rollers an electric motor 40 is mounted having a tooth belt drive 41 to a lay shaft 42 extending parallel to and below the roller assembly 14/15. The lay shaft carries a pair of toothed wheels 43 which mesh with and drive the toothed wheels 16 attached to the suction rollers 15. The shaft 42 also carries a toothed wheel 44 which meshes with and drives the toothed wheel 45 on the shaft 11 which extends through the suction rollers 15 and to which the central suction roller 14 is attached as described earlier.

The shaft 11 has a tooth belt drive 46 to one end of a further shaft 47 extending parallel to the suction rollers. The other end of the shaft carries a combined bevel gear/toothed pulley 48 and the toothed pulley part has a belt drive 49 extending to a parallel shaft 50 disposed above shaft 47. Spaced bevel gears 51 are mounted on the shaft 50 to mesh with bevel gears 52 on the pair of shafts 30 located to one side of the apparatus to rotate the shafts as aforesaid. The bevel gear part of the combined gear/pulley 48 meshes with a bevel gear 53 on one end of a shaft 54 extending across the apparatus. The other end of the shaft 54 carries a bevel gear 55 meshing with a further combined bevel gear/pulley 56 mounted on one end of a shaft 57 extending parallel to shaft 50. Shaft 57 is drivably connected to the two shafts 30 on the other side of the apparatus through bevel gearing 58. The pulley part of bevel gear/pulley 56 has a toothed belt drive 59 to the aforesaid shaft 11 on which suction rollers 17 is mounted. A further drive is provided for shaft 37 of additional roller 36.

The arrangement of rollers is, as indicated above, generally the same as that of the first described embodiment except that the roller 36 is located adjacent roller 17 instead of adjacent the composite roller assembly 14,15. Thus the central suction ports of roller 17 are operated through the valving previously described to draw out the bottom-most sheet from the stack and direct it downwardly through the nip between roller 17 and the adjacent roller 36. The photo-cell system described above for providing the input to a sheet counter device for counting the sheets extracted from the stack is indicated at 60 in FIG. 4.

A further difference in the second embodiment of the invention is that the fingers 32 for separating the longitudinal edges of the lowermost sheet of the stack from the sheet above are replaced by discs 61 mounted on the contra-rotating shaft 30. The discs have diametrically opposed outwardly projecting peripheral flange portions 62 which penetrate the stack at the centre between the lowermost sheet in the stack and the sheet above and then sweep outwardly to the longitudinal ends of the stack to separate the lowermost sheet along its edges from the sheet above in exactly the same manner as the fingers 32.

I claim:

1. An apparatus for separating sheets from a stack comprising a pair of parallel contra-rotatable cylindrical rollers for supporting a stack of sheets leaving edge portions on the sides of the stack un-supported, drive means for rotating the rollers in opposite directions such that the top surface of the rollers move away from each other as the rollers rotate, suction inlets located on the surfaces of the rollers adjacent the central regions thereof to act on the central regions of the edges of the lowermost sheet engaging the rollers to draw the central regions of said edge portions of the lowermost sheet downwardly as the suction inlets move outwardly under the lowermost sheet, separator means for penetrating the sides of the stack between the downwardly drawn central regions of the lowermost sheet and the stack above and for passing along the length of the edge portions to the ends of the stack to separate fully the edge portions from the stack above, and means to draw out the lowermost sheet from the bottom of the stack.

2. An apparatus as claimed in claim 1 wherein two suction inlets are provided on each roller disposed apart longitudinally along the roller on the sides of the roller centre to act on the edge portion of a sheet on either side of the centre thereof.

3. An apparatus as claimed in claim 1 or claim 2 wherein the suction means further includes rotary valves for controlling the vacuum for supply to the suction inlets of the rollers, the rotary valves being mounted coaxially with the rollers and driven by the roller drive means.

4. An apparatus as claimed in claim 1 wherein one of the rollers is formed in three longitudinally spaced parts comprising a central roller part in which said suction inlets are provided and which is driven at the same speed as the other roller and two further roller parts located at the ends of the central part and driven by the roller drive means at at least twice the speed of the central part and said suction means including further rotary valves arranged coaxially with the roller parts and driven by the said drive means, the arrangement being such that the suction inlets of the further roller parts begin to act on the lowermost sheet as the suction inlets of the central part disengage from the sheet and the separator means have acted, so that the sheet is then drawn out of the stack.

5. An apparatus as claimed in claim 4 wherein a third roller of smaller diameter is located adjacent said one roller and is driven in contra-rotation therewith by said drive means, the rollers forming between them a nip into which the sheet drawn out of the stack by the further roller parts is directed and through which the sheet is passed.

6. An apparatus as claimed in claim 1, wherein the separator means comprise fingers and means for moving the fingers into the stack adjacent the centre thereof where the lowermost sheet has been separated from the stack and moving the fingers along the sides of the stack to the ends of the stack to release the edge portions of the lowermost sheet from the stack above.

7. An apparatus as claimed in claim 6 wherein two sets of fingers are provided for entering the stack on the sides thereof respectively, each set of fingers comprising at least two fingers and the drive means for the fingers being arranged to move the fingers synchronously into the stack at the centre thereof and then outwardly in opposite directions towards the ends of the stack.

8. An apparatus as claimed in claim 7 wherein the drive means for the fingers comprise rotary drive means for rotating the fingers about vertical axes to move the fingers into the stack and then along the stack.

9. An apparatus as claimed in claim 8 wherein the fingers are mounted on vertically rotatable drive spindles, the fingers extending horizontally from the spindles to engage in the stack.

10. An apparatus as claimed in claim 9 wherein each spindle carries a pair of fingers projecting on diametrically opposite sides of the spindle and the drive means for the spindles are arranged to rotate the spindles at one half the speed of the first said rollers so that alternate fingers on each of the spindles engage in the stack.

11. The apparatus as claimed in claim 1 wherein the separator means comprise pairs of contra-rotatable discs disposed on either side of the location for receiving a stack, each disc having at least one peripheral flange portion extending radially outwardly of the disc periphery to engage in the stack at the centre thereof and to pass to one end of the stack to separate the longitudinal edges of the bottom-most sheet from the sheet above.

12. An apparatus as claimed in claim 11 wherein each disc has a pair of diametrically opposed arcuate flange portions with gaps between the portions to engage in and separate each lowermost sheet of the stack from the sheet above as the discs rotate.

13. An apparatus as claimed in claim 1 where the support means for the stack further includes a fixed support member extending between the upper parts of the first said rollers and having suction inlets for holding the sheet above in position on the support and the suction means further includes a rotary valve driven by the roller drive means for supplying suction to the suction inlets when required to hold a sheet in place on the support member.

14. An apparatus as claimed in claim 1 wherein a sheet counter is provided in the path of movement of the separated sheet from the rollers for counting sheets separated from the stack.

15. An apparatus as claimed in claim 14 wherein the sheet counter includes a photocell for detecting a sheet drawn out of the stack.

16. An apparatus as claimed in claim 1 wherein the support means is constructed to receive a stack of used banknotes for separation.

17. An apparatus for separating sheets from a stack comprising, means for supporting a stack of sheets leaving edge portions on the sides of the stack unsupported, each of said unsupported edge portions having a central region and end regions, suction means for drawing the central regions of said unsupported edge portions of the lowermost sheet downwardly below the end regions of said edge portions so that the unsupported edge portions have a concave curvature, pairs of separator means for both sides of the stack, means for projecting the pairs of separator means into the respective sides of the stack at the center of the stack between the downwardly drawn edge portions of the lowermost sheet and the sheet above and for moving the separator means of each pair apart along the edge portions to the ends of the stack to separate fully the edge portions of the lowermost sheet from the sheet above, and means for drawing out the lowermost sheet from the bottom of the stack.

* * * * *